US010441838B1

(12) United States Patent
Unger

(10) Patent No.: US 10,441,838 B1
(45) Date of Patent: Oct. 15, 2019

(54) DUMBBELL SUPPORT AND EXERCISE DEVICE

(71) Applicant: Steve A. Unger, Apache Junction, AZ (US)

(72) Inventor: Steve A. Unger, Apache Junction, AZ (US)

( * ) Notice: Subject to any disclaimer, the term of this patent is extended or adjusted under 35 U.S.C. 154(b) by 326 days.

(21) Appl. No.: 15/444,430

(22) Filed: Feb. 28, 2017

(51) Int. Cl.

| | |
|---|---|
| ***A63B 21/072*** | (2006.01) |
| ***A63B 21/00*** | (2006.01) |
| ***A63B 23/02*** | (2006.01) |
| ***A63B 21/075*** | (2006.01) |

(52) U.S. Cl.
CPC .... *A63B 21/0726* (2013.01); *A63B 21/00061* (2013.01); *A63B 21/00065* (2013.01); *A63B 21/075* (2013.01); *A63B 21/4027* (2015.10); *A63B 23/0211* (2013.01)

(58) Field of Classification Search
CPC ..... A63B 21/00058; A63B 21/00061; A63B 21/00065; A63B 21/00069; A63B 21/00072; A63B 21/00076; A63B 21/00185; A63B 21/062; A63B 21/065; A63B 21/068; A63B 21/072; A63B 21/0722; A63B 21/0724; A63B 21/0726; A63B 21/0728; A63B 21/075; A63B 21/08; A63B 21/15; A63B 21/159; A63B 21/16; A63B 21/1609; A63B 21/1681; A63B 21/169; A63B 21/4023; A63B 21/4025; A63B 21/4027; A63B 21/4033; A63B 21/4034; A63B 21/4035; A63B 21/4039; A63B 21/4041; A63B 21/4043; A63B 22/0046; A63B 23/02; A63B 23/0205; A63B 23/0222; A63B 26/00; A63B 26/003; A63B 69/0057; A63B 69/0059; A63B 69/0064; A63B 2069/0062; A63B 71/0036; A63B 2210/00; A63B 2210/50; A63B 2225/09; A63B 2225/093; A63B 2244/09
See application file for complete search history.

(56) References Cited

U.S. PATENT DOCUMENTS

| | | | | | |
|---|---|---|---|---|---|
| 3,235,255 | A * | 2/1966 | Leflar | A63B 21/0724 | 482/104 |
| 4,666,150 | A * | 5/1987 | Segrist | A63B 21/078 | 482/104 |
| 4,773,642 | A | 9/1988 | Cruz | | |
| 4,828,252 | A * | 5/1989 | Bowen | A63B 21/078 | 473/438 |
| 4,861,025 | A * | 8/1989 | Rockwell | A63B 21/06 | 482/142 |

(Continued)

FOREIGN PATENT DOCUMENTS

| | | | | |
|---|---|---|---|---|
| GB | 2505964 A * | 3/2014 | A63B 21/072 | |
| WO | 9939778 A1 | 8/1999 | | |

*Primary Examiner* — Gary D Urbiel Goldner

(57) ABSTRACT

The dumbbell support and exercise device is configured for use with a plurality of readily and commercially available dumbbells. The dumbbell support and exercise device is an exercise stand configured for use with resistance based strength exercises. The dumbbell support and exercise device receives and supports the plurality of dumbbells. The weight applied through the plurality of dumbbells is then used in resistance based exercises for strength training purposes. The dumbbell support and exercise device comprises a base, a plurality of weight stands, and a bar.

9 Claims, 7 Drawing Sheets

(56) References Cited

U.S. PATENT DOCUMENTS 5,098,361 A * 3/1992 Danylieko ..... A63B 21/0615 482/106
5,108,354 A * 4/1992 Becker ..... A63B 23/12 482/104
5,116,297 A * 5/1992 Stonecipher ..... A63B 21/0615 482/137
5,411,459 A * 5/1995 Hayden ..... A63B 21/078 482/104
5,725,460 A * 3/1998 Marsh ..... A63B 21/078 482/104
5,769,762 A * 6/1998 Towley, III ..... A63B 21/0605 482/107
5,772,561 A * 6/1998 Hayden ..... A63B 21/078 482/104
5,779,604 A * 7/1998 Towley, III ..... A63B 21/0728 482/107
5,924,964 A * 7/1999 Hayden ..... A63B 21/4029 482/104
D425,152 S * 5/2000 Ceppo ..... D21/662
D429,295 S 8/2000 Ceppo
6,149,556 A * 11/2000 Jordan ..... A63B 71/0036 482/104
D443,660 S 6/2001 Ceppo
D453,542 S * 2/2002 Louiso ..... D21/686
D487,490 S * 3/2004 Evans ..... A63B 21/078 D21/686
6,709,370 B1 * 3/2004 Evans ..... A63B 21/078 482/104
6,896,644 B1 * 5/2005 Voigt ..... A63B 21/078 482/104
D508,628 S * 8/2005 Crawford ..... D6/552
7,070,547 B1 * 7/2006 Pater ..... A63B 21/078 482/104
D528,173 S * 9/2006 Flick ..... D21/686
7,285,077 B1 * 10/2007 Marx ..... A63B 21/06 482/104
D578,173 S * 10/2008 James ..... D21/686
7,534,198 B1 5/2009 Strong
7,578,771 B1 * 8/2009 Towley, III ..... A63B 1/04 482/106
7,678,030 B2 3/2010 Savage
D623,245 S * 9/2010 Evans ..... D21/686
D639,359 S * 6/2011 Rauwerdink ..... D21/686
D671,997 S * 12/2012 Lien ..... D21/662
D676,092 S * 2/2013 Bledson ..... D21/690
9,033,854 B1 * 5/2015 Butkovic ..... A63B 21/078 482/104
D743,713 S * 11/2015 Flick ..... D6/552
9,211,436 B1 * 12/2015 Torres ..... A63B 21/072
D755,909 S * 5/2016 James ..... D21/686
9,492,701 B1 * 11/2016 Bognatz ..... A63B 21/072
9,610,490 B2 * 4/2017 Tambornino ..... A63B 71/0036
9,717,943 B2 * 8/2017 Klonoski ..... A63B 21/078
10,143,875 B2 * 12/2018 Moschel ..... A63B 21/00047
D837,560 S * 1/2019 Hendricks ..... D6/552
2002/0183174 A1 * 12/2002 Chen ..... A63B 21/075 482/108
2005/0009671 A1 * 1/2005 Hummer, Jr. ..... A63B 71/0036 482/94
2007/0049472 A1 * 3/2007 Hummer, Jr. ..... A63B 71/0036 482/104
2007/0082795 A1 * 4/2007 Murray ..... A63B 21/078 482/104
2007/0099773 A1 * 5/2007 Hummer, Jr. ..... A63B 71/0036 482/104
2007/0155595 A1 * 7/2007 Rogers ..... A63B 21/0615 482/94
2008/0070759 A1 * 3/2008 Chaulk ..... A63B 21/078 482/104
2010/0041531 A1 * 2/2010 Rochford ..... A63B 21/04 482/148
2012/0157271 A1 * 6/2012 Bauer ..... A63B 71/0036 482/104
2012/0252640 A1 * 10/2012 Drechsler ..... A63B 21/0724 482/104
2012/0252643 A1 * 10/2012 Drechsler ..... A63B 21/0552 482/129
2015/0087485 A1 * 3/2015 Kimura ..... A63B 21/078 482/104
2015/0343296 A1 * 12/2015 Francis ..... A63B 21/078 482/104
2017/0028246 A1 * 2/2017 Vorozilchak ..... A63B 21/078
2017/0361149 A1 * 12/2017 Duffin ..... A63B 21/0783
2018/0008878 A1 * 1/2018 Myre ..... A63B 21/075

* cited by examiner

DUMBBELL SUPPORT AND EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports games and amusements including apparatus for physical training, more specifically, an apparatus for strengthening muscles by working against a counterforce.

SUMMARY OF INVENTION

The dumbbell support and exercise device is configured for use with a plurality of readily and commercially available dumbbells. The dumbbell support and exercise device is an exercise stand configured for use with resistance based strength exercises. The dumbbell support and exercise device receives and supports the plurality of dumbbells. The weight applied through the plurality of dumbbells is then used in resistance based exercises for strength training purposes.

These together with additional objects, features and advantages of the dumbbell support and exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the dumbbell support and exercise device in detail, it is to be understood that the dumbbell support and exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dumbbell support and exercise device.

It is therefore important that the claims be regarded as including such equivalent construction insofar as they do not depart from the spirit and scope of the dumbbell support and exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
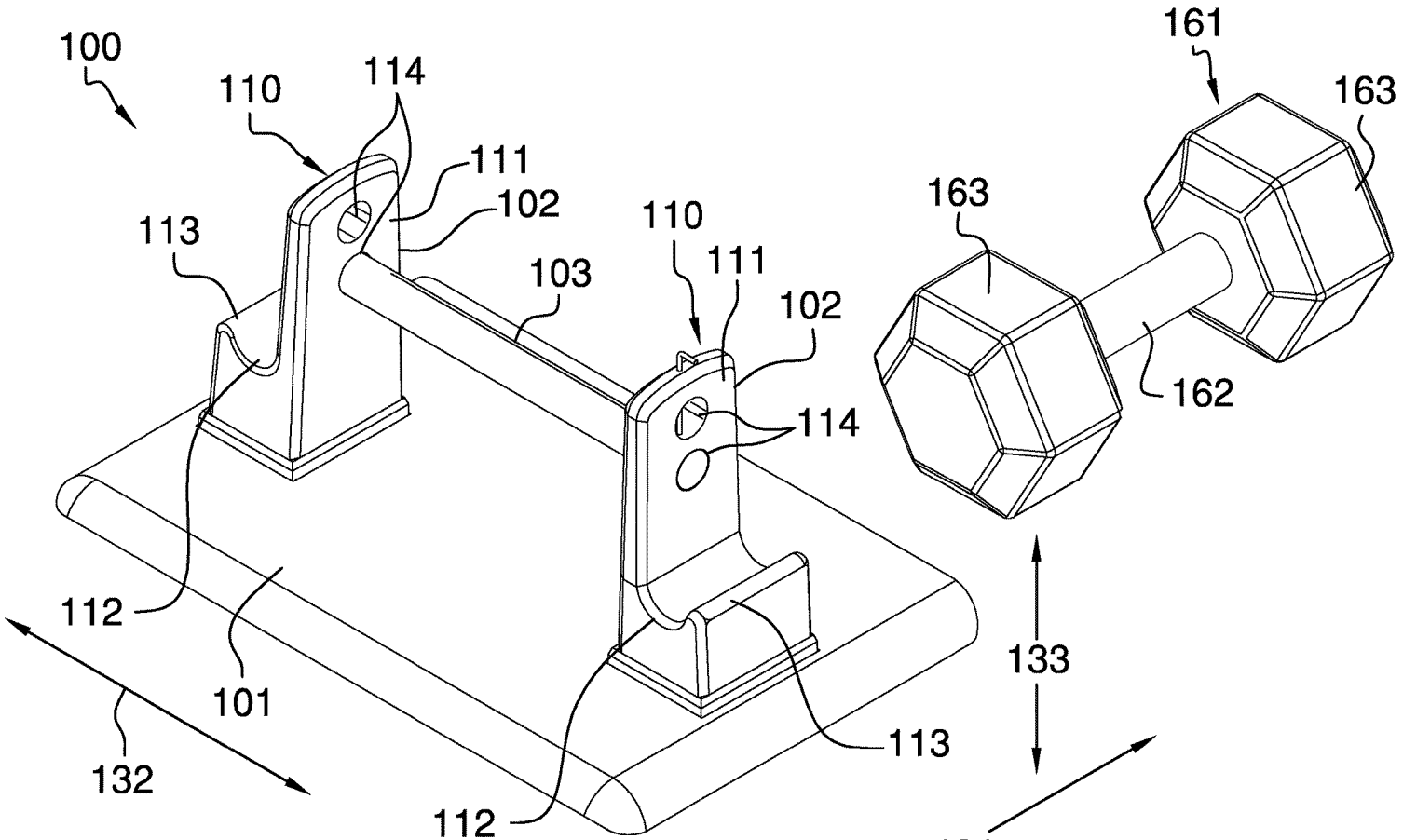
FIG. 1 is a perspective view of an embodiment of the disclosure.
Figure 2:
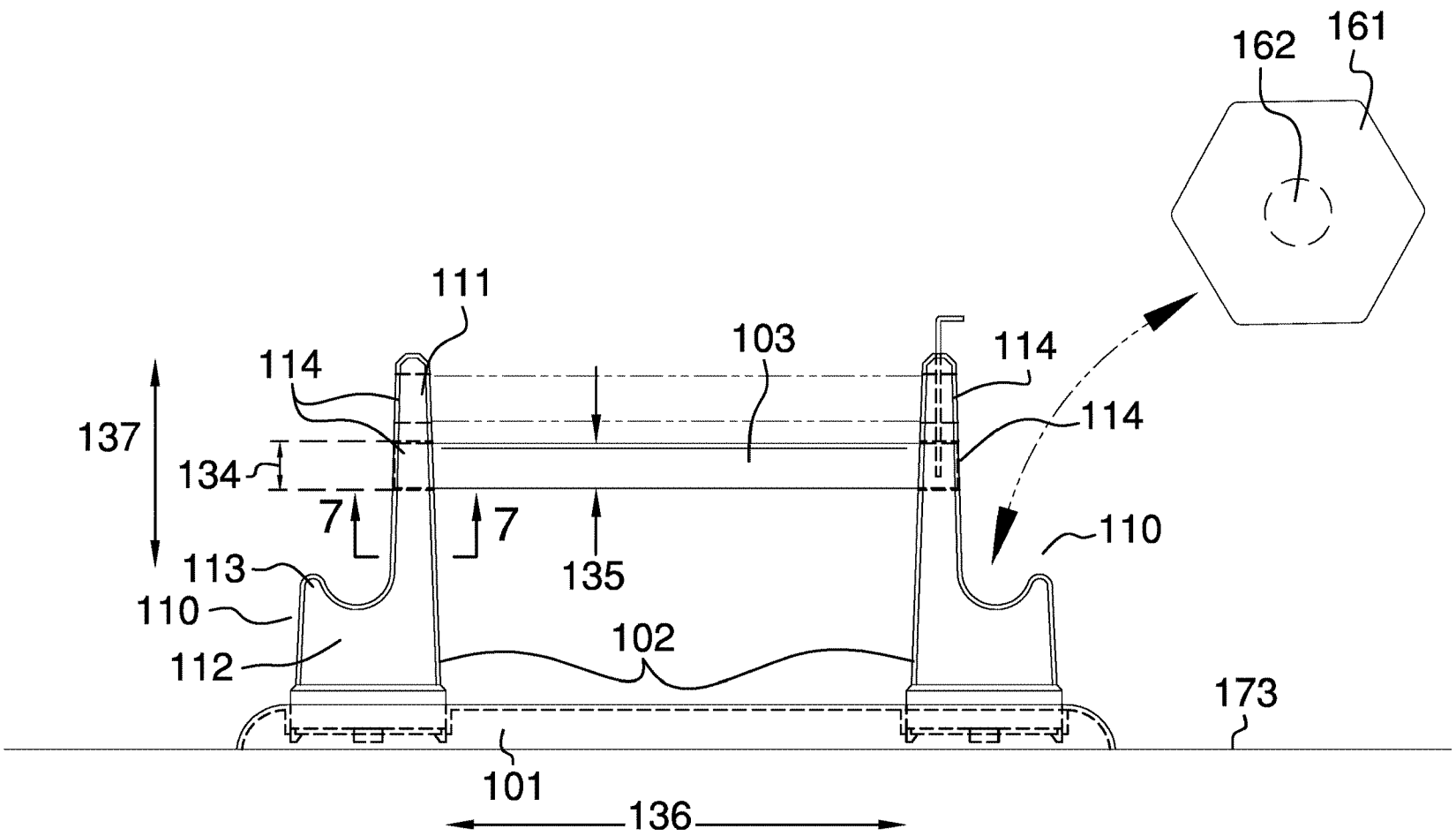
FIG. 2 is a front view of an embodiment of the disclosure.
Figure 3:
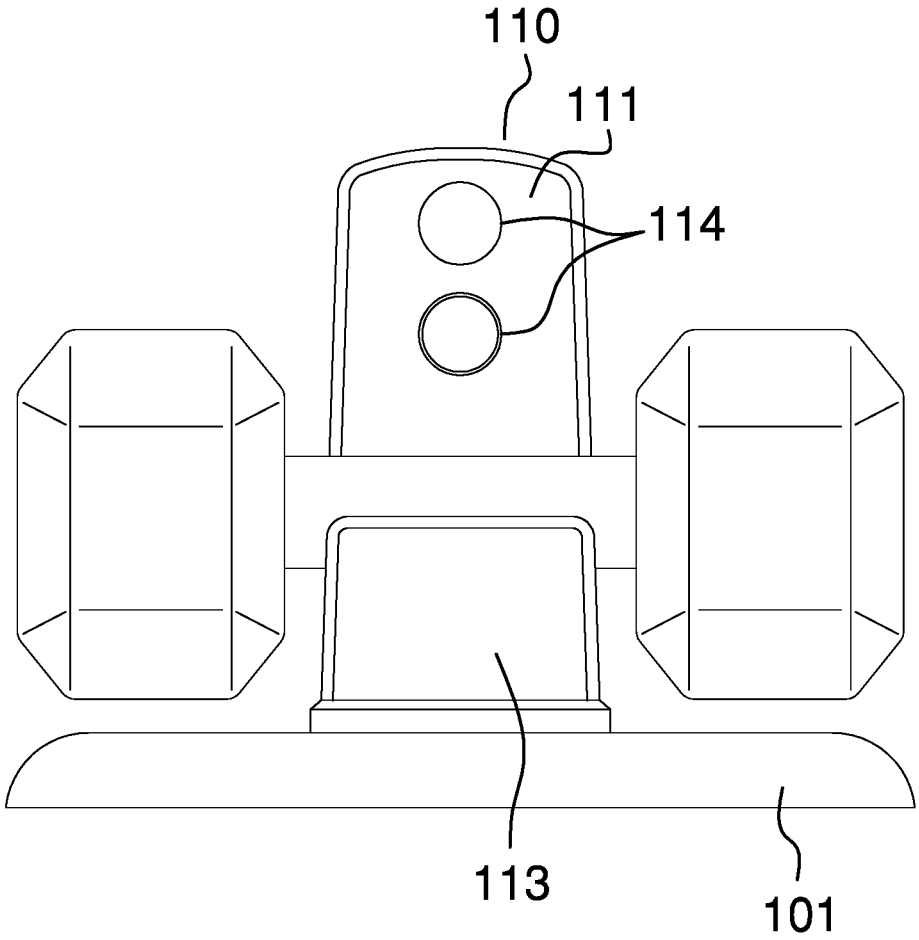
FIG. 3 is a side view of an embodiment of the disclosure.
Figure 4:
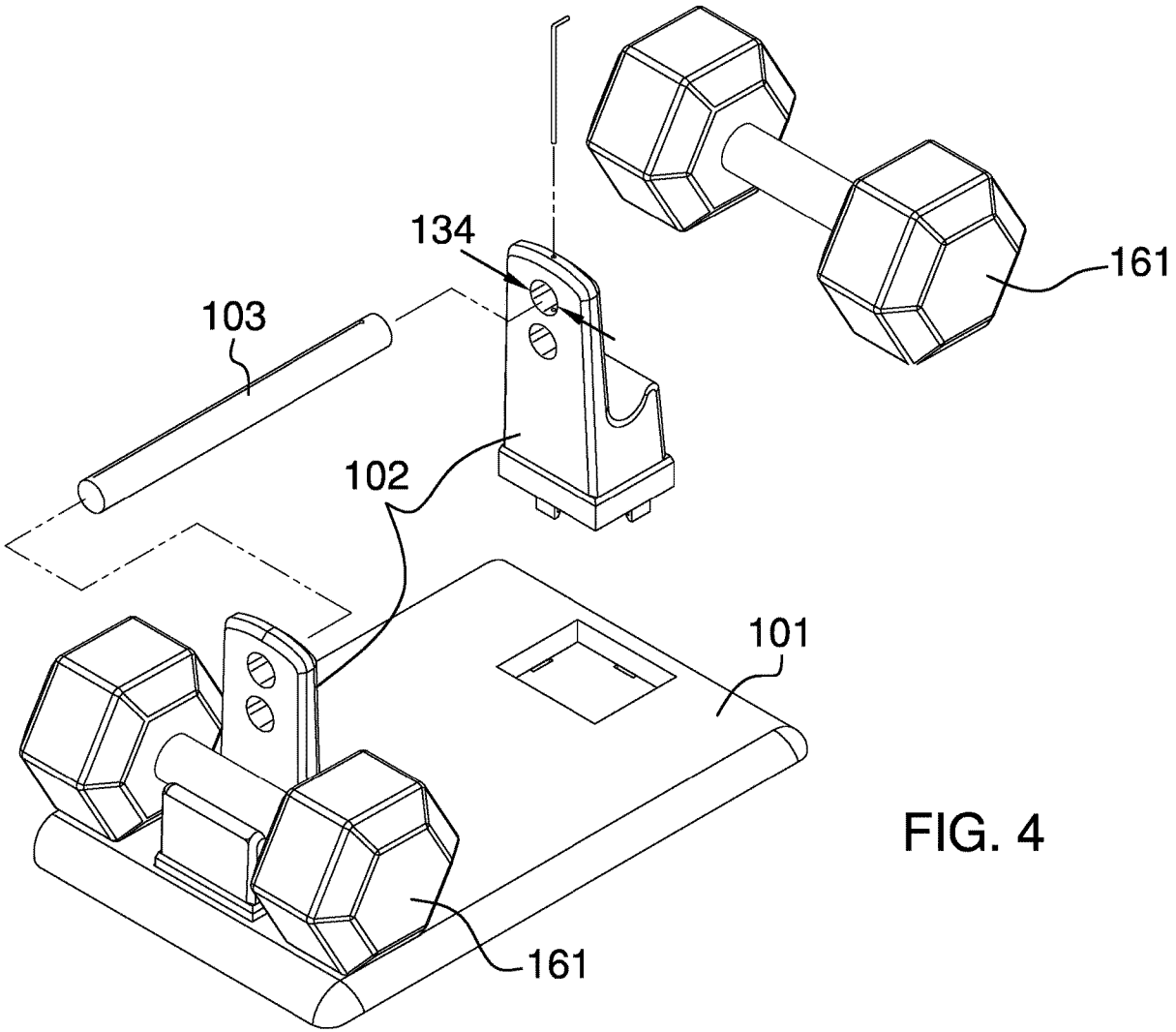
FIG. 4 is an in use view of an embodiment of the disclosure.
Figure 5:
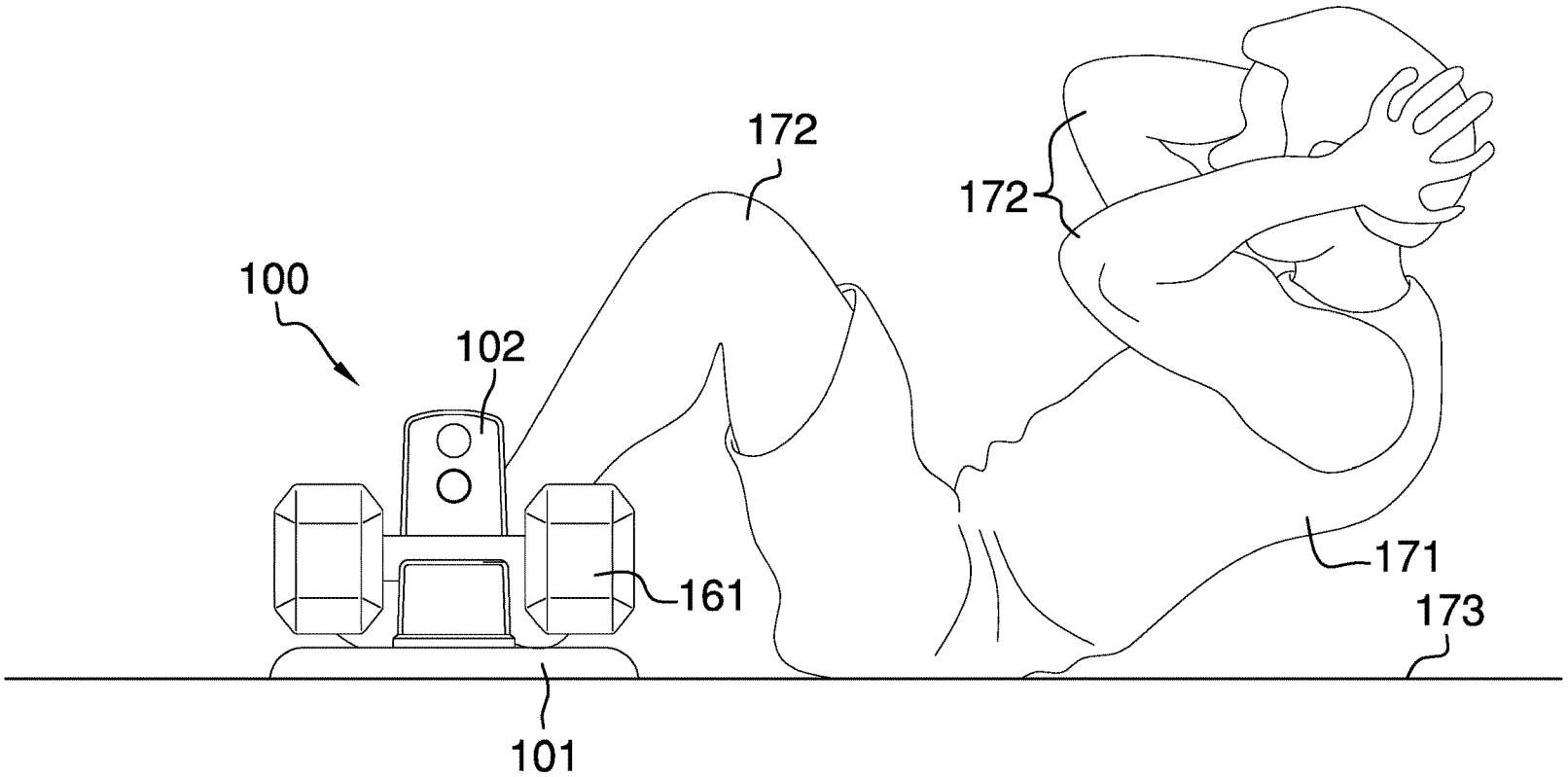
FIG. 5 is an in use view of an embodiment of the disclosure.
Figure 6:
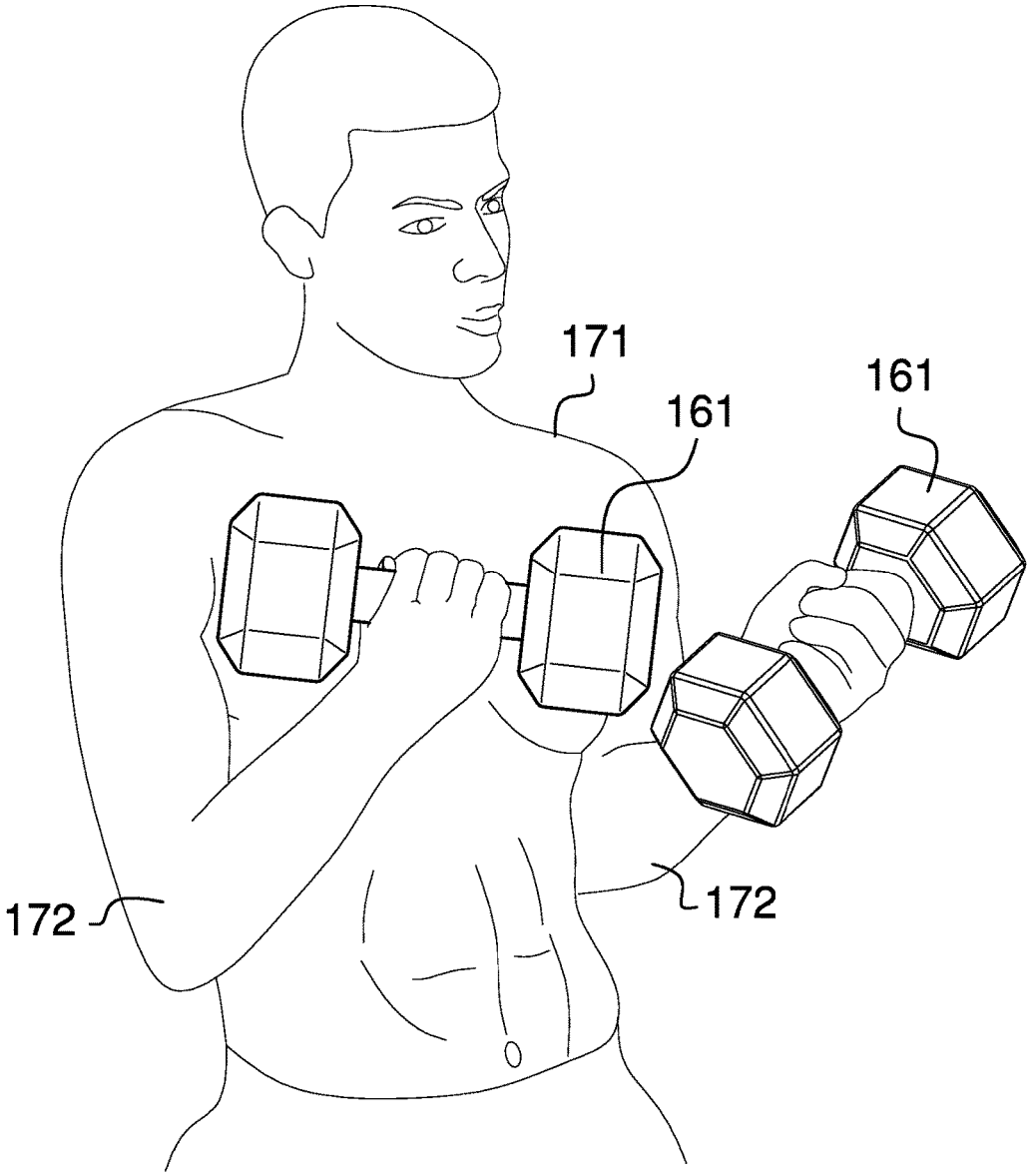
FIG. 6 is an in use view of an embodiment of the disclosure.
Figure 7:
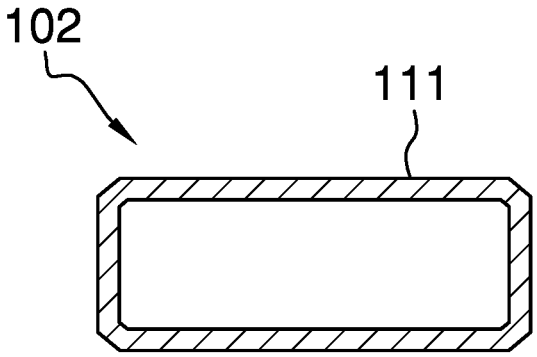
FIG. 7 is a cross-sectional view of an embodiment of the disclosure across 7-7 as shown in FIG. 2.
Figure 8:
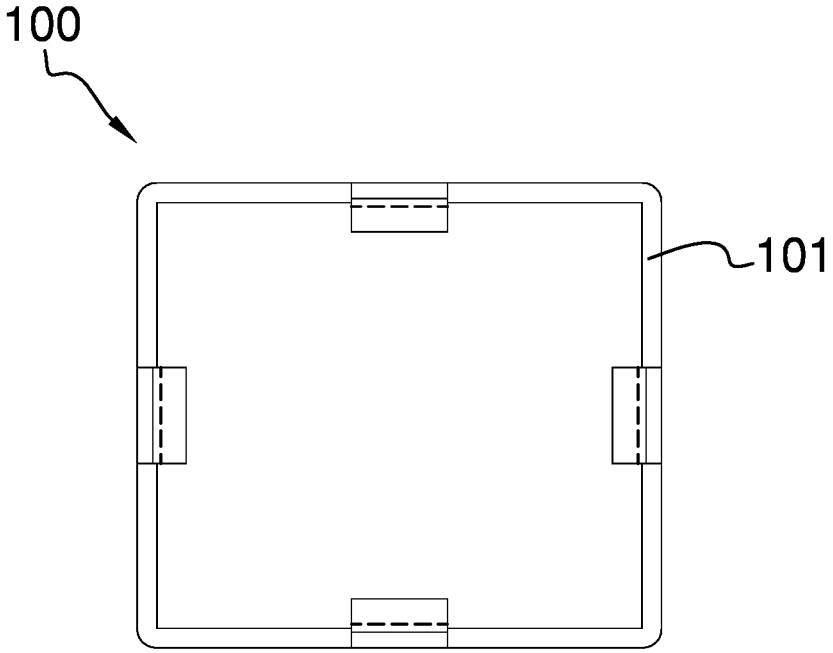
FIG. 8 is a bottom view of an embodiment of the disclosure.

Detailed reference will now be made to one or more potential embodiments of the disclosure, which are illustrated in FIGS. 1 through 8.

The dumbbell support and exercise device 100 (hereinafter invention) comprises a base 101, a plurality of weight stands 102, and a bar 103. The invention 100 is configured for use with a readily and commercially available plurality of dumbbells 161. Each of the plurality of dumbbells 161 is a readily and commercially available hand held weight that is commonly used for training activities. Each of the plurality of weight stands 102 attaches to the base 101. In the first potential embodiment of the disclosure, as shown most clearly in FIG. 4, each of the plurality of weight stands 102 is removably attached to the base 101. Each of the plurality of weight stands 102 receives a dumbbell selected from the plurality of dumbbells 161. The bar 103 attaches a first weight stand selected from the plurality of weight stands 102 to a second weight stand selected from the plurality of weight stands 102 for the purpose of providing an anchor point to be used during training. The invention 100 is an exercise stand configured for use with resistance based strength training. The invention 100 receives and supports the plurality of dumbbells161. The weight applied through the plurality of dumbbells 161 is then used by a person 171 in resistance based exercises for strength training purposes. Each of the plurality of dumbbells 161 is further defined with a handle 162 and a plurality of end weights 163. The handle 162 is a grip by which a dumbbell selected from the plurality of dumbbells 161 is manipulated. Each of the plurality of end weights 163 is a structure that is attached to the handle 162 of each of the plurality of dumbbells 161 for the purpose of adding mass to the dumbbell selected from the plurality of dumbbells 161. In addition to their traditional uses, the plurality of dumbbells 161 acts as a counterweight that stabilizes a person's ankles when the ankles are positioned under the bar 103. The person 171 is defined to be an individual that is performing training activities with the invention 100. The person 171 is further defined with one or more limbs 172. By the one or more limbs 172 of the person 171 is meant the arms or legs of the person 171.

The base 101 is a rectangular plate that serves as the foundation of the invention 100. The base 101 is placed proximal to a supporting surface 173 during use of the invention 100. The base 101 is further defined with a width 131, a length 132, and a height 133. The width 131 is a designated direction that is in the horizontal 137 plane formed by the base 101. The width 131 direction of the base 101 determines the width 131 direction of the invention 100. The length 132 is the direction of the base 101 that is: 1) in the horizontal 137 plane formed by the base 101; and, 2) is in a direction perpendicular to the width 131 direction. The height 133 is the direction of the invention 100 that is: 1) in the vertical 136 direction, 2) perpendicular to the width 131 direction; and, 3) perpendicular to the length 132 direction.

Each of the plurality of weight stands 102 is a stand that is mounted on the base 101. Each of the plurality of weight stands 102 receives a dumbbell selected from the plurality of dumbbells 161. The plurality of weight stands 102 comprises a collection of individual weight stands. Each individual weight stand comprises a back 111, a seat 112, one or more chocks 113, and a plurality of apertures 114. The individual weight stand is a structure that is designed to receive a dumbbell selected from the plurality of dumbbells 161. The span of the width 131 of each individual weight stand is less than the span of the handle 162 of the selected dumbbell such that the each of the plurality of end weights 163 of the selected dumbbell will clear the individual weight stand 110.

The back 111 is a plate structure that: 1) attaches to the bar 103; and, 2) prevents the dumbbell stored within the individual weight stand from shifting off the individual weight stand. The back 111 is attached to the seat 112 such that the back 111 projects perpendicularly away from the seat 112. The seat 112 is the rectangular block structure that provides the supporting structure upon which the handle 162 of the dumbbell selected from the plurality of dumbbells 161 is placed and supported during use of the invention 100. The height 133 of the seat 112 is such that each of the plurality of end weights 163 will clear the base 101 when a dumbbell selected from the plurality of dumbbells 161 is placed in the individual weight stand.

Each of the one or more chocks 113 is a shaft that is mounted on the seat 112 such that the each of the one or more chocks 113 projects perpendicularly away from the seat 112 in the vertical 136 direction. Each of the one or more chocks 113 prevents the dumbbell installed within the individual weight stand 110 from shifting off the individual weight stand.

Each of the plurality of apertures 114 is a hole formed through the back 111 of an individual weight stand selected from the plurality of weight stands 102. Each of the plurality of apertures 114 is further defined with an inner diameter 134. Each of the plurality of apertures 114 are evenly distributed between each of the individual weight stands 110 contained within the plurality of weight stands 102.

The bar 103 is a cylindrical shaft. The bar 103 is used an anchor point for use by the one or more limbs 172 of the person 171. The bar 103 is further defined with an outer diameter 135. The inner diameter 134 of the each of the plurality of apertures 114 is larger than the outer diameter 135 of the bar 103 such that the bar 103 can be inserted into and supported by any aperture selected from the plurality of apertures 114.

In the first potential embodiment of the disclosure, the plurality of weight stands 102 comprises a first weight stand and a second weight stand. To use the first potential embodiment of the disclosure, as shown most clearly in FIGS. 4 and 5, the bar 103 is inserted into an aperture selected from a sub-plurality of apertures selected from the plurality of apertures 114 that are formed within the first weight stand. The bar 103 is simultaneously inserted into an aperture selected from a sub-plurality of apertures selected from the plurality of apertures 114 that are formed within the second weight stand. A first dumbbell selected from the plurality of dumbbells 161 is placed into the first weight stand such that the handle 162 of the first selected dumbbell is positioned between the back 111 and the one or more chocks 113 of the first weight stand. A second dumbbell selected from the plurality of dumbbells 161 is placed into the second weight stand such that the handle 162 of the second selected dumbbell is positioned between the back 111 and the one or more chocks 113 of the second weight stand. The one or more limbs 172 of the person 171 is then anchored to the bar 103 for the purpose of strength training. In the first potential embodiment of the disclosure, the plurality of apertures 114 comprises four apertures.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Diameter: As used in this disclosure, the term inner diameter is used in the same way that a plumber would refer to the inner diameter of a pipe.

Outer Diameter: As used in this disclosure, the term outer diameter is used in the same way that a plumber would refer to the outer diameter of a pipe.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A strength training apparatus comprising:

a base, a plurality of weight stands, and a bar;

wherein the strength training apparatus is configured for use with a plurality of dumbbells;

wherein the plurality of weight stands comprises a first weight stand and a second weight stand respectively receiving a dumbbell selected from the plurality of dumbbells, the first weight stand and the second weight stand are each attached to the base and respectively attached to each other by the bar;

wherein the strength training apparatus receives and supports the plurality of dumbbells such that weight applied through the plurality of dumbbells is configured to enable the strength training apparatus to be used in resistance based exercises by a person having one or more limbs;

wherein each of the plurality of dumbbells comprises a first end weight and a second end weight respectively attached to opposing ends of a handle;

wherein the handle is a grip by which a dumbbell selected from the plurality of dumbbells is manipulated;

wherein each of the first and second end weights add mass to the dumbbell selected from the plurality of dumbbells;

wherein the person is defined to be an individual that is performing training activities with the strength training apparatus;

wherein the person is further defined with one or more limbs;

wherein the base is a rectangular plate forming a horizontal plane placed proximal to a supporting surface;

wherein the base comprises a width, a length, and a height mutually perpendicular to each other and respectively corresponding to a width direction, a length direction, and a vertical direction of both the base and the strength training apparatus; and wherein the width direction and the length direction reside in the horizontal plane;

wherein each of the first and second weight stands is a stand that is mounted on the base;

wherein each of the first and second weight stands comprises a back, a seat, and one or more chocks;

wherein the back and the one or more chocks attach to the seat;

wherein a span of a width of each of the first and second weight stands is less than a span of the handle of the respective selected dumbbell;

wherein the back is a plate structure;

wherein the back attaches to the bar;

wherein the respective back prevents the selected dumbbell stored within each of the first and second weight stands from respectively shifting off each of the first and second weight stands;

wherein the back is attached to the seat such that the back projects perpendicularly away from the seat;

wherein the seat is a rectangular block structure;

wherein the respective seat provides a supporting structure upon which the handle of the respective selected dumbbell is responsively placed and supported.

2. The strength training apparatus according to claim 1 wherein a height of the respective seat is such that each of the first and second end weights are spaced a vertical distance above the base when the respective selected dumbbell is respectively placed in each of the first and second weight stands.

3. The strength training apparatus according to claim 1 wherein each of the one or more chocks is a shaft that is mounted on the seat;

wherein each of the one or more chocks is mounted on the seat such that each of the one or more chocks projects perpendicularly away from the seat in the vertical direction;

wherein each of the one or more chocks prevents the selected dumbbell respectively installed within each of the first and second weight stands from respectively shifting off each of the first and second weight stands.

4. The strength training apparatus according to claim 2 wherein each of the first and second weight stands further comprises a plurality of apertures;

wherein each of the plurality of apertures is a hole formed through the respective back of each of the first and second weight stands;

wherein each of the plurality of apertures is further defined with an inner diameter.

5. The strength training apparatus according to claim 4 wherein each of the first and second weight stands comprises a same number of apertures.

6. The strength training apparatus according to claim 5 wherein the bar is a cylindrical shaft;

wherein the bar is an anchor point for use by the one or more limbs of the person;

wherein the bar is further defined with an outer diameter.

7. The strength training apparatus according to claim 6 wherein the inner diameter of the each of the plurality of apertures is larger than the outer diameter of the bar such that the bar can be inserted into and supported by any aperture selected from the plurality of apertures.

8. The strength training apparatus according to claim 7 wherein the bar is inserted into an aperture selected from the plurality of apertures that are formed within the first weight stand;

wherein the bar is simultaneously inserted into an aperture selected from the plurality of apertures that are formed within the second weight stand.

9. The strength training apparatus according to claim 8 wherein a first dumbbell selected from the plurality of dumbbells is placed into the first weight stand such that the handle of the first selected dumbbell is positioned between the back and the one or more chocks of the first weight stand;

wherein a second dumbbell selected from the plurality of dumbbells is placed into the second weight stand such that the handle of the second selected dumbbell is positioned between the back and the one or more chocks of the second weight stand.

* * * * *